US010036314B2

(12) United States Patent
Hackett et al.

(10) Patent No.: US 10,036,314 B2
(45) Date of Patent: Jul. 31, 2018

(54) FUEL SYSTEM FLUSH CIRCUITRY AND METHOD FOR OPERATING THE SAME

(71) Applicant: Caterpillar Inc., Peoria, IL (US)

(72) Inventors: David E. Hackett, Washington, IL (US); Martin Lehman, Congerville, IL (US); Scott F. Shafer, Morton, IL (US)

(73) Assignee: Caterpillar Inc., Deerfield, IL (US)

( * ) Notice: Subject to any disclaimer, the term of this patent is extended or adjusted under 35 U.S.C. 154(b) by 134 days.

(21) Appl. No.: 14/992,287

(22) Filed: Jan. 11, 2016

(65) Prior Publication Data

US 2017/0198633 A1 Jul. 13, 2017

(51) Int. Cl.

| | |
|---|---|
| ***F01N 3/00*** | (2006.01) |
| ***F02B 77/04*** | (2006.01) |
| ***F02B 3/06*** | (2006.01) |
| ***F02M 65/00*** | (2006.01) |
| ***F01N 3/20*** | (2006.01) |

(52) U.S. Cl.

CPC ..... *F02B 77/04* (2013.01); *F01N 3/206* (2013.01); *F02B 3/06* (2013.01); *F02M 65/008* (2013.01); *F01N 2610/1493* (2013.01); *F02B 2077/045* (2013.01)

(58) Field of Classification Search

CPC ..... F01N 2610/1493; F01N 3/206; F02B 2077/045; F02B 3/06; F02B 77/04; F02M 65/008

USPC ..... 60/286, 303

See application file for complete search history.

(56) References Cited

U.S. PATENT DOCUMENTS

| | | | | |
|---|---|---|---|---|
| 7,779,818 | B2 | 8/2010 | Wilson et al. | |
| 8,820,052 | B2 * | 9/2014 | Levin | F01N 3/2066 60/274 |
| 9,316,216 | B1 * | 4/2016 | Cook | F04B 23/06 |
| 2004/0025498 | A1 * | 2/2004 | Lambert | B01D 53/90 60/286 |
| 2004/0083723 | A1 * | 5/2004 | Hager | B01D 53/9431 60/286 |
| 2014/0182553 | A1 | 7/2014 | Lee | |
| 2015/0013642 | A1 | 1/2015 | Yudanov | |

FOREIGN PATENT DOCUMENTS

| | | | |
|---|---|---|---|
| DE | 19828933 | A1 | 1/2000 |
| DE | 19937674 | * | 2/2001 |
| DE | 19937674 | A1 | 2/2001 |
| DE | 102013006303 | A1 | 10/2014 |
| WO | 2011004740 | A1 | 1/2011 |

* cited by examiner

*Primary Examiner* — Phutthiwat Wongwian
*Assistant Examiner* — Diem Tran
(74) *Attorney, Agent, or Firm* — Baker Hostetler

(57) ABSTRACT

A fluid injection system includes a fluid injector assembly, a fluid conditioning module having an outlet port that is fluidly coupled to an inlet port of the fluid injector assembly via an injector assembly inlet conduit. The fluid injection system further includes a flush conduit fluidly coupled to the outlet port of the fluid conditioning module, a flush valve disposed in the flush conduit and configured to control a flowrate of fluid therethrough, and a controller operatively coupled to the fluid conditioning module and the flush valve, the controller being configured to adjust a flowrate of a fluid through the injector assembly inlet conduit by controlling a flowrate of fluid through the flush conduit.

13 Claims, 7 Drawing Sheets

FUEL SYSTEM FLUSH CIRCUITRY AND METHOD FOR OPERATING THE SAME

TECHNICAL FIELD

The present disclosure relates generally to fluid conditioning systems and, more particularly, to fluid conditioning systems for supplying a fluid to one or more fluid injectors and methods for operating the same.

BACKGROUND

Reciprocating internal combustion (IC) engines are known for converting chemical energy, stored in a fuel supply, into mechanical shaft power. A fuel-oxidizer mixture is received in a variable volume to an IC engine defined by a piston translating within a cylinder bore. The fuel-oxidizer mixture burns inside the variable volume to convert chemical energy from the mixture into heat. In turn, expansion of the combustion products within the variable volume performs work on the piston, which may be transferred to an output shaft of the IC engine.

Combustion engines may inject high pressure liquid fuel directly into the variable volume, and a liquid fuel delivery system may employ two or more fuel pumping stages in series to achieve the desired final injection pressure. For example, unit pump fuel systems for direct injection compression ignition engines may include a fuel transfer pump that draws fuel from a fuel tank and delivers the fuel to the inlet of a unit pump driven by a cam or hydraulic piston, for example, to further increase the fuel pressure to the desired injection pressure.

The evolution of diesel fuel injection systems has involved ever increasing injection pressures. As pressures increase, the wear of the high pressure fuel systems (HPFS) increases exponentially. To address this wear new filtration strategies may be developed to ensure that the low pressure fuel system (LPFS) provides very clean fuel to the HPFS. Any time the LPFS is opened (e.g., initial system build, filter change or system repair, etc.), dirt and debris may be introduced into the system, which can compromise the durability of the HPFS.

International patent application publication No. WO2011/004740 purports to describe a dimethyl ether (DME) fuel supply method in which a target supply amount of DME is supplied into a fuel tank of an engine through a fuel supply line. In the DME fuel supply method, the fuel supply line is opened, thereafter, a pressure difference is monitored. When the pressure difference is below a predetermined set value, a purging electromagnetic valve (RV-2) for the fuel tank is opened. When the pressure difference is above the predetermined set value, the purging electromagnetic valve (RV-2) is closed. The purging method of WO2011/004740 is triggered on a pressure measurement below specification and does not address the filtration of dirt and debris.

One strategy used to mitigate contamination by dirt/debris is to install a "last chance" filter right before fluid enters the HPFS. However, even this filter can introduce debris when the filter is removed from the system for replacement. Furthermore, determination of filter clogging may be difficult.

German patent application publication No. DE19828933 purports to describe a conventional system consisting of a fuel pump with a suction and a delivery filter. A monitor measures the potential of the positive lead to the pump, which is proportional to its power demand. The changing power demand, at the various levels at which the engine works, is then an analogue of the state of the filters so that a warning light on the dashboard can be lit when a predetermined limit is exceeded. However, the varying pressure of a HPFS may mask the correlation between power demand and an actual state of the filter. As such, these and other shortcomings of the prior art are addressed by the present disclosure.

It will be appreciated that this background description has been created to aid the reader, and is not to be taken as a concession that any of the indicated problems were themselves known in the art.

SUMMARY

According to an aspect of the disclosure, a fluid injection system includes a fluid injector assembly, a fluid conditioning module having an outlet port that is fluidly coupled to an inlet port of the fluid injector assembly via an injector assembly inlet conduit. The fluid injection system further includes a flush conduit fluidly coupled to the outlet port of the fluid conditioning module, a flush valve disposed in the flush conduit and configured to control a flowrate of fluid therethrough, and a controller operatively coupled to the fluid conditioning module and the flush valve, the controller being configured to adjust a flowrate of a fluid through the injector assembly inlet conduit by controlling a flowrate of fluid through the flush conduit.

A machine may comprise: an internal combustion engine; and a fluid injection system operatively coupled to the internal combustion engine, the fluid injection system including a fluid injector assembly having at least one fluid injector in fluid communication with the internal combustion engine; a fluid conditioning module having an outlet port that is fluidly coupled to an inlet port of the fluid injector assembly via an injector assembly inlet conduit; a flush conduit fluidly coupled to the outlet port of the fluid conditioning module; a flush valve disposed in the flush conduit and configured to control a flowrate of fluid therethrough; and a controller operatively coupled to the fluid conditioning module and the flush valve, the controller being configured to adjust a flowrate of a fluid through the injector assembly inlet conduit by controlling the flowrate of fluid through the flush conduit.

In certain aspects, a method is disclosed for operating a fluid conditioning system, the fluid conditioning system including a fluid injector assembly, a fluid conditioning module comprising a motor system configured to cause fluid to flow through a filter to an outlet port that is fluidly coupled to an inlet port of the fluid injector assembly via an injector assembly inlet conduit, and a flush conduit fluidly coupled to the outlet port of the fluid conditioning module. The method may comprise: causing fluid to flow through the flush conduit; measuring a power demand of the motor system of the fluid conditioning module; and determining a loading of the filter based on at least the measured power demand.

DETAILED DESCRIPTION

Aspects of the disclosure will now be described in detail with reference to the drawings, wherein like reference numbers refer to like elements throughout, unless specified otherwise.

Figure 1:
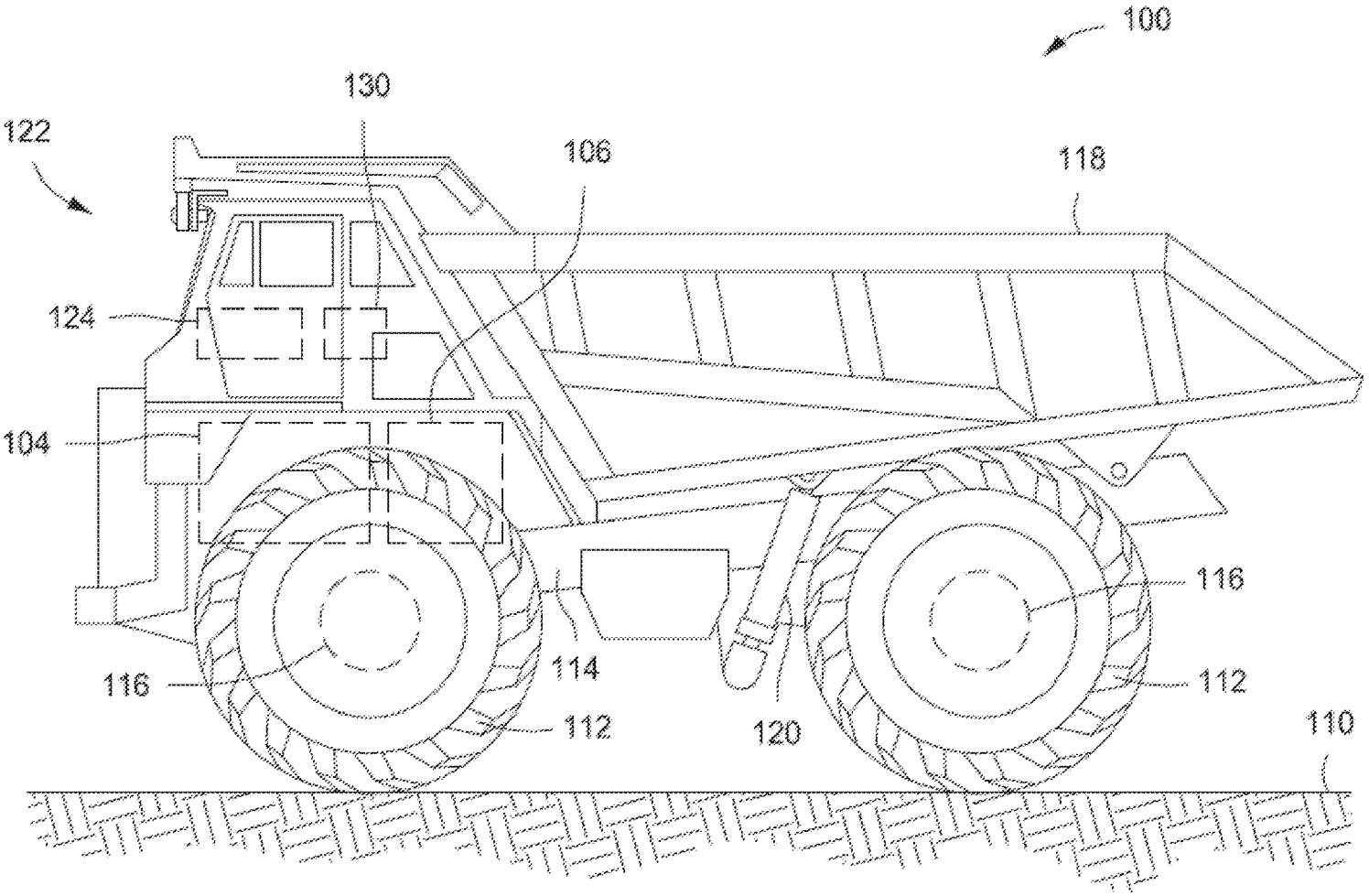
FIG. 1 is a schematic side view of a machine, according to an aspect of the disclosure.

FIG. 1 shows a side view of a machine 100, according to an aspect of the disclosure. The machine 100 includes an internal combustion (IC) engine 104 that is fluidly coupled to a fuel supply system 106. The IC engine 104 maybe a reciprocating internal combustion engine, such as a compression ignition engine or a spark ignition engine, for example, or a rotating internal combustion engine, such as a gas turbine, for example.

The machine 100 may be propelled over a work surface 110 by wheels 112 coupled to a chassis 114. The wheels 112 may be driven by a drive system such as motors 116, a mechanical transmission coupled to the IC engine 104, or combinations thereof. It will be appreciated that the machine 100 could also be propelled by tracks (not shown), combinations of wheels 112 and tracks, or any other surface propulsion device known in the art. Alternatively, the machine 100 could be a stationary machine, and therefore may not include a propulsion device.

The machine 100 may also include a work implement 118 driven by an actuator 120. The work implement 118 could be a dump bed, a shovel, a drill, a fork lift, a feller-buncher, a conveyor, or any other implement known in the art for performing work on a load. The actuator 120 may be a hydraulic actuator, such as a linear hydraulic motor or a rotary hydraulic motor, an electric motor, a pneumatic actuator, or any other actuator known in the art.

The machine may include a cab 122 configured to accommodate an operator, and have a user interface 124 including using input devices for asserting control over the machine 100. The user interface 124 may include pedals, wheels, joysticks, buttons, touch screens, combinations thereof, or any other user input device known in the art. Alternatively or additionally, the user interface 124 may include provisions for receiving control inputs remotely from the cab 122, including wired or wireless telemetry, for example. The IC engine 104, the fuel supply system 106, and the user interface 124 may be operatively coupled to one another via a machine controller 130.

The machine may be an "over-the-road" vehicle such as a truck used in transportation or may be any other type of machine that performs some type of operation associated with an industry such as mining, construction, farming, transportation, or any other industry known in the art. For example, the machine may be an off-highway truck; an earth-moving machine, such as a wheel loader, an excavator, a dump truck, a backhoe, a motor grader, or a material handler; a marine vessel; a locomotive; or any other machine known in the art. The term "machine" can also refer to stationary equipment, such as a generator that is driven by an internal combustion engine to generate electricity; a pump or a compressor that is driven by an internal combustion engine, or any other stationary drive machine known in the art. The specific machine 100 illustrated in FIG. 1 is a dump truck having a dump bed 118 actuated by a linear hydraulic cylinder 120.

Figure 2:
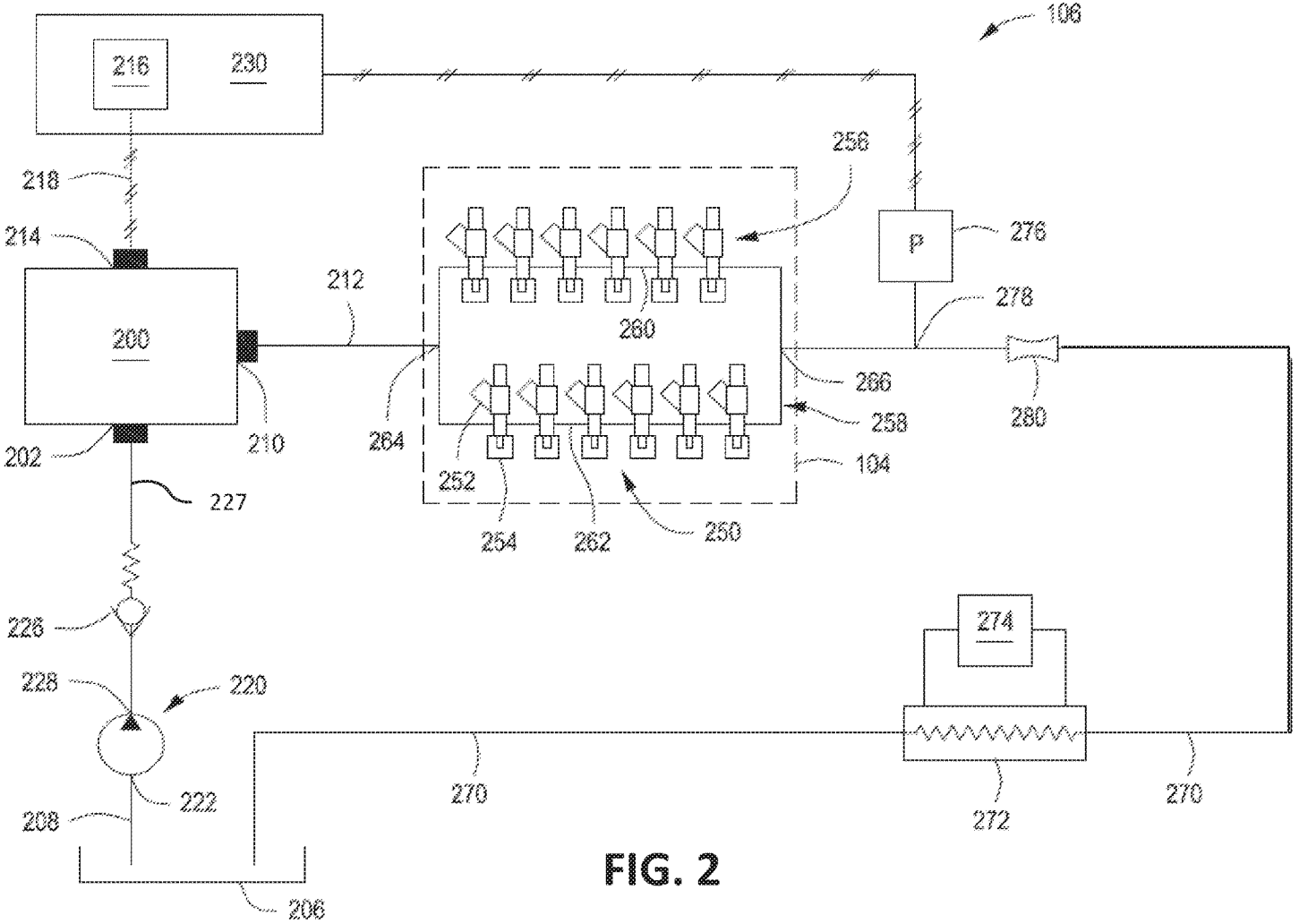
FIG. 2 is a schematic view of a fluid injection system, according to an aspect of the disclosure.

FIG. 2 shows a schematic view of a fuel supply system 106, according to an aspect of the disclosure. The fuel supply system 106 includes a fluid conditioning module 200 having an inlet port 202 that is in fluid communication with a fluid reservoir 206 via a suction conduit 208. The fluid reservoir 206 may be a liquid fuel reservoir that supplies one or more liquid fuels to the IC engine 104, such as, distillate diesel, biodiesel, dimethyl ether, seed oils, ethanol, methanol, combinations thereof, or any other combustible liquid known in the art.

An outlet port 210 of the fluid conditioning module 200 may be in fluid communication with the IC engine 104 via a module outlet conduit 212. The fluid conditioning module 200 may include pumps, valves, filters, sensors, heaters, coolers, controllers, combinations thereof, or any other structures known in the art to be beneficial to conditioning a fluid. According to an aspect of the disclosure, the fluid conditioning module 200 includes a high-pressure common rail fuel pump.

A power port 214 of the fluid conditioning module 200 may be operatively coupled to a power source 216 via a power conduit 218. The power source 216 may be an electrical power source, a hydraulic power source, a pneumatic power source, a shaft power source, combinations thereof, or any other power source known in the art. The power conduit 218 may include an electrical conductor, a fluid conduit, a shaft, combinations thereof, or any other means for transmitting power or control signals known in the art. Further, the power conduit 218 may also be configured to transmit communication signals between the fluid conditioning module 200 and a controller 230, such as instrumentation signals, for example.

According to an aspect of the disclosure, the power source 216 is an electrical power source, and the power conduit 218 consists of one or more electrical conductors. According to another aspect of the disclosure, the power source 216 is part of the controller 230. It will be appreciated that the controller 230 may be integrated with the machine controller 130 or a controller for the engine 104, or the controller 230 may be distinct from the machine controller 130, an engine controller, or both.

The fluid conditioning module 200 may be fluidly coupled to the fluid reservoir 206 via a low-pressure transfer pump 220, which takes suction from the fluid reservoir 206 via the suction conduit 208. Alternatively, the fluid conditioning module 200 includes a pump, and the fluid reservoir 206 may provide sufficient net positive suction head to the fluid conditioning module 200 such that the low-pressure transfer pump 220 is not necessary, and is therefore not included in the fuel supply system 106.

An inlet 222 of the low-pressure transfer pump 220 may be fluidly coupled to the fluid reservoir 206 via suction conduit 208, and an outlet 228 of the low-pressure transfer pump 220 may be coupled to the inlet port 202 of the fluid conditioning module 200 via a check valve 226 disposed in a module inlet conduit 227. Alternatively, the check valve 226 may be disposed upstream of the low-pressure transfer pump 220 along a flow direction from the fluid reservoir 206 to the fluid conditioning module 200. Further, it will be appreciated that the inlet port 202 of the fluid conditioning module 200 may be fluidly coupled to the fluid reservoir 206 via the check valve 226 independent of whether the fuel supply system 106 includes the low-pressure transfer pump 220. The check valve 226 is configured to allow flow through the suction conduit 208 only in a direction from the fluid reservoir 206 toward the fluid conditioning module 200.

According to the aspect illustrated in FIG. 2, the outlet port 210 of the fluid conditioning module 200 is fluidly coupled to the IC engine 104 via a fluid injector assembly 250. The fluid injector assembly 250 may include one or more fuel injectors 252 operatively coupled to combustion chambers 254 of the IC engine 104 for delivering fuel to the combustion chambers 254 defined at least in part by a block of the IC engine 104. According to another aspect of the disclosure, the fluid injector assembly 250 includes one or more exhaust aftertreatment fluid injectors that are fluidly coupled to an exhaust duct of the IC engine 104 and configured to deliver exhaust aftertreatment fluid to an exhaust flow through the exhaust duct.

The one or more fuel injectors 252 may include a first bank of fuel injectors 256 and a second bank of fuel injectors 258, such that the fuel injectors 252 composing the first bank of fuel injectors 256 are fluidly plumbed in series with one another along a first fuel rail 260, and the fuel injectors 252 composing the second bank of fuel injectors 258 are fluidly plumbed in series with one another along a second fuel rail 262. The first bank of fuel injectors 256 may be plumbed in parallel with the second bank of fuel injectors 258, such that the first bank of fuel injectors 256 and the second bank of fuel injectors 258 share a common fluid inlet 264 and a common fluid outlet 266. Alternatively, the one or more fuel injectors 252 may be fluidly plumbed in series with one another along a single fuel rail, or any other fluid arrangement to suit a particular application.

According to an aspect of the disclosure, the first fuel rail 260, the second fuel rail 262, or both, may be defined by flow passages within a block or cylinder head of the IC engine 104. However, it will be appreciated that the first fuel rail 260, the second fuel rail 262, or both, may be defined by tubing disposed outside a block or cylinder head of the IC engine 104.

The fluid reservoir 206 may be in fluid communication with a return conduit 270. The return conduit 270 may optionally include a heat exchanger 272 that is configured to transfer heat away from a flow of fuel through the return conduit 270. The heat exchanger 272 may be fluidly and/or thermally coupled to a heat transfer fluid source 274 to transfer heat away from the heat exchanger 272. The heat transfer fluid source 274 may include a source of coolant for the IC engine 104, a source of ambient air, or a source of any other cooling fluid medium known in the art.

A pressure sensor 276 may be fluidly coupled to a pressure measurement port 278 along the return conduit 270. According to an aspect of the disclosure, the pressure measurement port 278 may be defined by a block or cylinder head of the engine 104. The pressure sensor 276 may be operatively coupled to the controller 230 for receipt of electrical power, transmission of a pressure signal indicative of a pressure at the pressure measurement port 278, or combinations thereof. A flow-restricting orifice 280 may be fluidly disposed in series with the pressure measurement port 278 along the return conduit 270, and downstream of the pressure measurement port 278 along a flow direction through the fuel injector assembly 250.

As shown in FIG. 2, both the pressure measurement port 278 and the flow-restricting orifice 280 are disposed downstream of the common fluid outlet 266 of the fuel injector assembly 250 along a flow direction through the return conduit 270. According to another aspect of the disclosure, the pressure measurement port 278, the flow-restricting orifice 280, or both, may be disposed downstream of a most downstream fuel injector of the fuel injector assembly 250 along a flow direction through the fuel injector assembly 250. However, it will be appreciated that other arrangements of the pressure measurement port 278, the flow-restricting orifice 280 may be employed to suit other applications without departing from the scope of the present disclosure.

According to an aspect of the disclosure, the flow-restricting orifice 280 has a flow area that is smaller than a flow area of the return conduit 270 at the pressure measurement port 278. According to another aspect of the disclosure, the flow-restricting orifice 280 has a flow area that is no greater than half of a flow area of the return conduit 270 at the pressure measurement port 278. According to another aspect of the disclosure, the flow-restricting orifice 280 has a flow area that is smaller than a flow area of the first fuel rail 260, the second fuel rail 262, or both. According to another aspect of the disclosure, the flow-restricting orifice 280 has a flow area that is smaller than half of a flow area of the first fuel rail 260, the second fuel rail 262, or both.

Although the fluid conditioning module 200 is shown in the context of a fuel supply system 106 in FIG. 2, it will be appreciated that the fluid conditioning module 200 could be used to condition and supply other fluid injection systems with other fluids, such as, hydraulic fluid, coolant, water, lubricating oil, exhaust aftertreatment fluid, combinations thereof, or any other fluid known in the art. For example, the fuel injector assembly 250 could be an exhaust aftertreatment fluid injection assembly that is configured to inject exhaust aftertreatment fluid into an exhaust stream of the IC engine 104 instead of the combustion chambers 254 of the IC engine 104. Exhaust aftertreatment fluid may include a reductant, such as urea or ammonia, or any other fluid known in the art to benefit emissions aftertreatment of exhaust gas from an internal combustion engine. Unless specified otherwise, the term "fluid" is used herein to describe gases, liquids, slurries, combinations thereof, or other similar matter that tends to flow in response to applied sheer stress.

Figure 3:
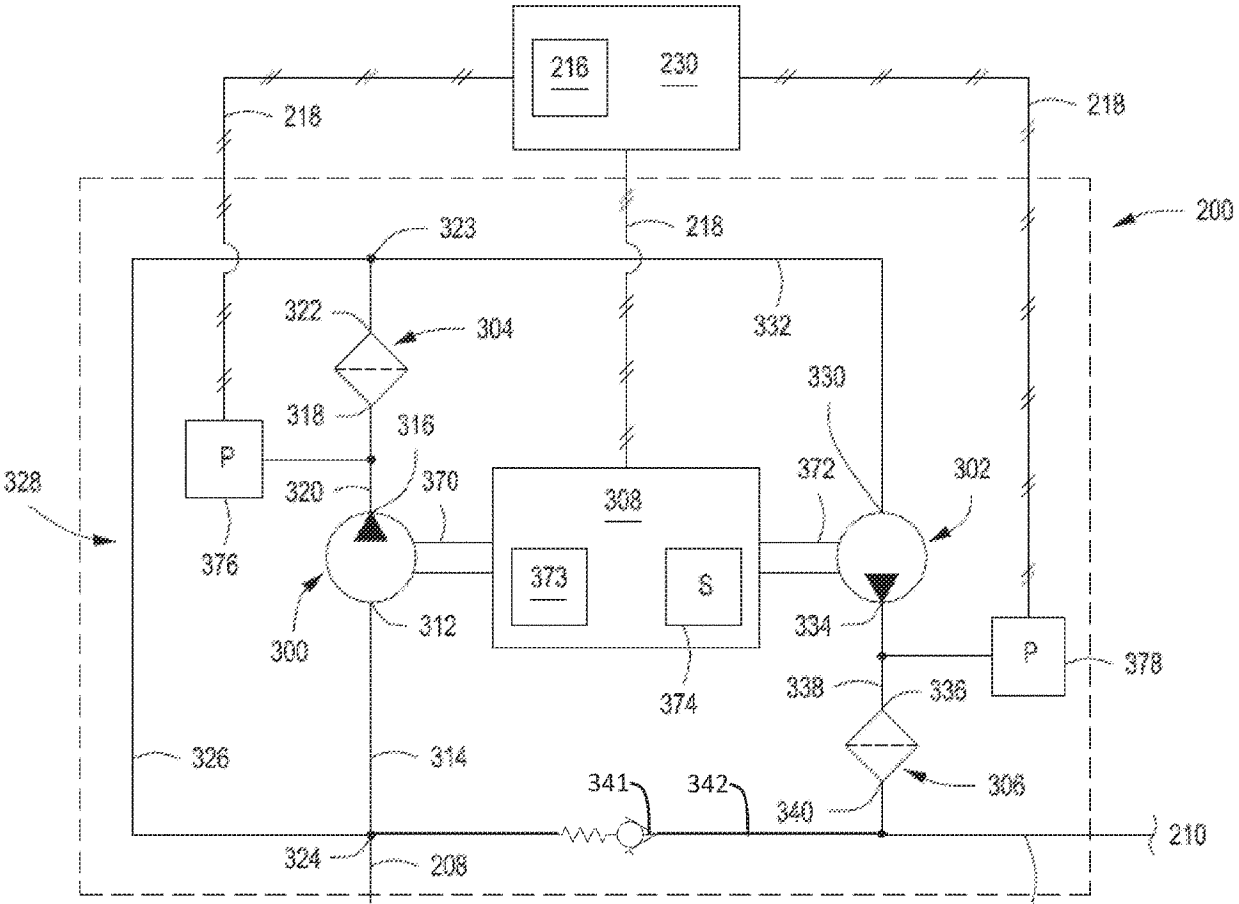
FIG. 3 is a schematic view of a fluid conditioning module, according to an aspect of the disclosure.

FIG. 3 shows a schematic view of a fluid conditioning module 200, according to an aspect of the disclosure. The fluid conditioning module 200 illustrated in FIG. 3 includes a recirculation pump 300, a delivery pump 302, a motor system 308, a first filter 304, and a second filter 306.

An inlet 312 to the recirculation pump 300 is fluidly coupled to the inlet port 202 of the fluid conditioning module 200, and therefore the fuel suction conduit 208, via a recirculation pump inlet conduit 314. An outlet 316 from the recirculation pump 300 is fluidly coupled to an inlet port 318 of the first filter 304 via a first filter inlet conduit 320. An outlet port 322 of the first filter 304 is fluidly coupled to the recirculation pump inlet conduit 314 at a fluid node 324 via a first filter outlet conduit 326. Accordingly, the first filter inlet conduit 320, the first filter outlet conduit 326, and the recirculation pump inlet conduit 314 form a fluid recirculation loop 328, which includes the first filter 304, about the recirculation pump 300.

An inlet 330 to the delivery pump 302 is fluidly coupled to the outlet port 322 of the first filter 304 via a delivery pump inlet conduit 332. Further, the delivery pump inlet conduit 332 may be fluidly coupled to the first filter outlet conduit 326 at the fluid node 323.

According to an aspect of the disclosure, the recirculation pump 300 may be a turbomachine, such as, for example, a centrifugal pump. According to another aspect of the disclosure, the delivery pump 302 may have a positive displacement design, such as, for example, a gerotor or external gear pump construction. However, it will be appreciated that either the recirculation pump 300 or the delivery pump 302 may be a turbomachine, a positive displacement pump, or any other pump known in the art, to satisfy the needs of a particular application.

An outlet 334 from the delivery pump 302 is fluidly coupled to an inlet port 336 of the second filter 306 via a second filter inlet conduit 338. An outlet port 340 of the second filter 306 is fluidly coupled to the outlet port 210 of the fluid conditioning module 200 via the module outlet conduit 212. As illustrated, a valve 341 may be disposed in a fluid conduit 342 that is fluidly coupled to the outlet port 210 and the fluid node 324. As an example, the valve 341 is a check valve configured to allow fluid to flow toward the fluid node 324 under predetermined pressure conditions.

The recirculation pump 300 may be operatively coupled to the motor system 308 via a first shaft 370 for transmission of shaft power therebetween, and the delivery pump 302 may be operatively coupled to the motor system 308 via a second shaft 372 for transmission of shaft power therebetween. The motor system 308 may be powered by electrical power, hydraulic power, pneumatic power, combinations thereof, or any other motor power source known in the art.

According to an aspect of the disclosure, the motor system 308 may be configured to drive the first shaft 370 at the same angular velocity as the second shaft 372. According to another aspect of the disclosure, the motor system 308 may include gearing 373 operatively coupled to the first shaft 370, the second shaft 372, or both, such that an angular velocity for the first shaft 370 is different from the angular velocity of the second shaft according to a prescribed relationship as a function of the angular velocity of the motor system 308. Alternatively, the recirculation pump 300 and the delivery pump 302 may be operatively coupled to a common shaft (not shown). The motor system 308 may include a speed sensor 374 that is operatively coupled to the controller 230 for transmitting a signal to the controller that is indicative of a speed of the motor system 308.

According to an aspect of the disclosure, the motor system 308 may be a variable speed motor and the controller 230 may be configured to vary a rotational speed of the motor system 308. Further, the controller 230 may be configured to vary a speed of the motor system 308 based on a comparison between a pressure signal from the pressure sensor 276 (see FIG. 2) and a predetermined threshold value. According to another aspect of the disclosure, the motor system 308 may be a constant speed motor, and the controller 230 may be configured to actuate the motor system 308 between a stopped condition and a fixed-speed condition.

The controller 230 may be any purpose-built processor for effecting control of the fluid conditioning module 200. It will be appreciated that the controller 230 may be embodied in a single housing, or a plurality of housings distributed throughout the fluid conditioning module 200. Further, the controller 230 may include power electronics, preprogrammed logic circuits, data processing circuits, volatile memory, non-volatile memory, software, firmware, input/output processing circuits, combinations thereof, or any other controller structures known in the art.

The fluid conditioning module 200 may include a pressure sensor 376 in fluid communication with the first filter inlet conduit 320 and operatively coupled to the controller 230 for transmitting a pressure signal to the controller 230 that is indicative of a pressure at the inlet port 318 of the first filter 304. Alternatively or additionally, the fluid conditioning module 200 may include a pressure sensor 378 in fluid communication with the second filter inlet conduit 338 and operatively coupled to the controller 230 for transmitting a pressure signal to the controller 230 that is indicative of a pressure at the inlet port 336 of the second filter 306.

Figure 4:
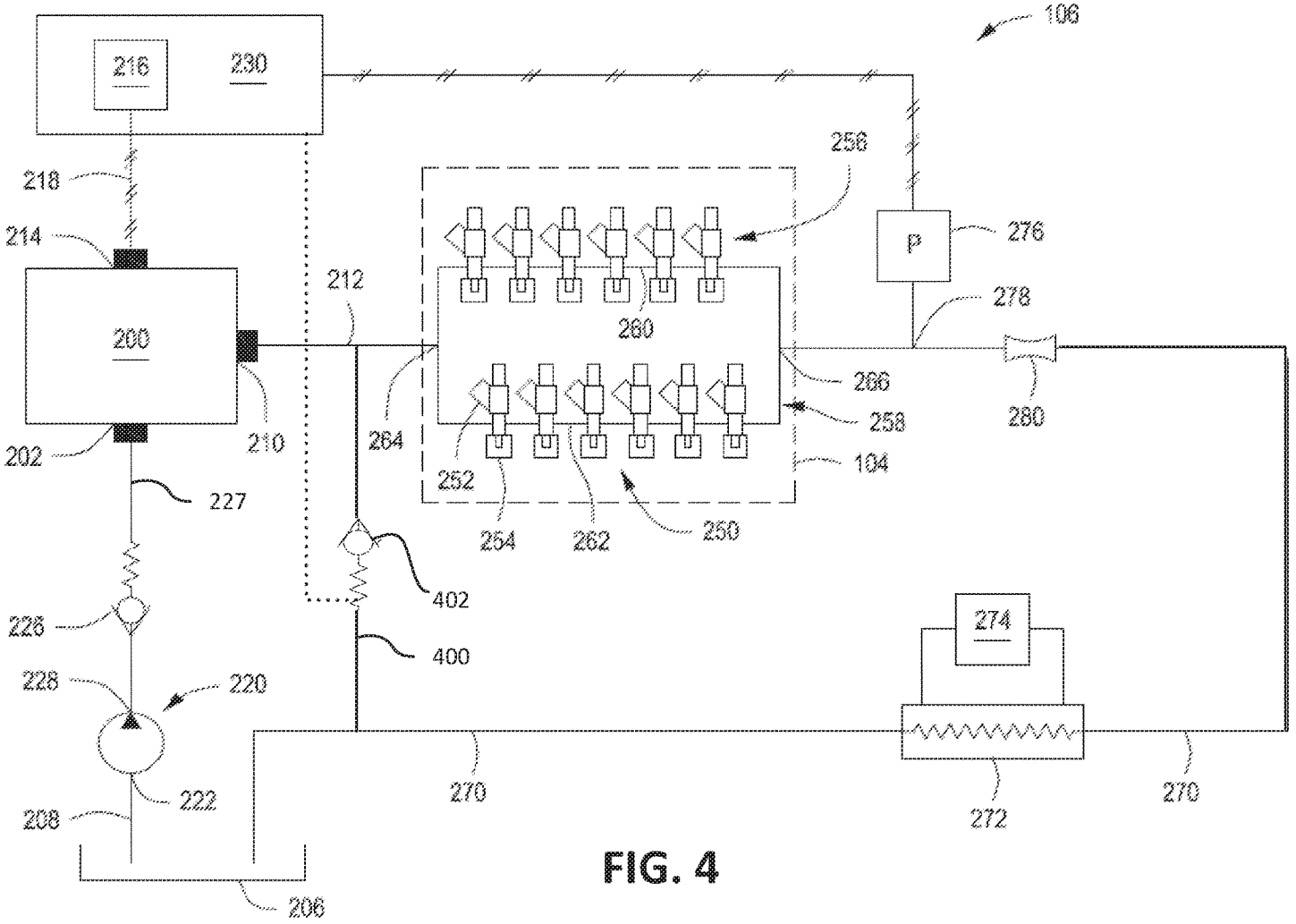
FIG. 4 is a schematic view of a fluid injection system, according to an aspect of the disclosure.

FIG. 4 shows a schematic view of a fuel supply system 106, according to an aspect of the disclosure. The fuel supply system 106 illustrated in FIG. 4 is similar to that illustrated in FIG. 2, however, as illustrated in FIG. 4, a flush conduit 400 may be fluidly coupled to the outlet port 210 of the fluid conditioning module 200, for example, via fluid communication with the module outlet conduit 212. The flush conduit 400 may be in fluid communication with the outlet port 210 via communication with the common fluid outlet 266. As such, the flush conduit 400 may be position upstream and/or downstream of the fluid injector assembly 250. For example, air, debris, and/or dirt may be flushed from the fuel supply system 106 without having to operate the fluid injector assembly 250.

The flush conduit 400 may be in fluid communication with the fluid reservoir 206, for example, via fluid communication with the return conduit 270. As shown, a flush valve 402 may be disposed in the flush conduit 400 and may be configured to control a flowrate of fluid therethrough. In certain aspects, the flush valve 402 may be an electrically controlled valve. As an example, the controller 230 may be operatively coupled to the flush valve 402. As such, the controller 230 may be configured to adjust a flowrate of a fluid through the injector assembly inlet conduit 264 by controlling a flowrate of fluid through the flush conduit 400. In other aspects, the flush valve 402 may be configured as a pressure relief valve.

Figure 5:
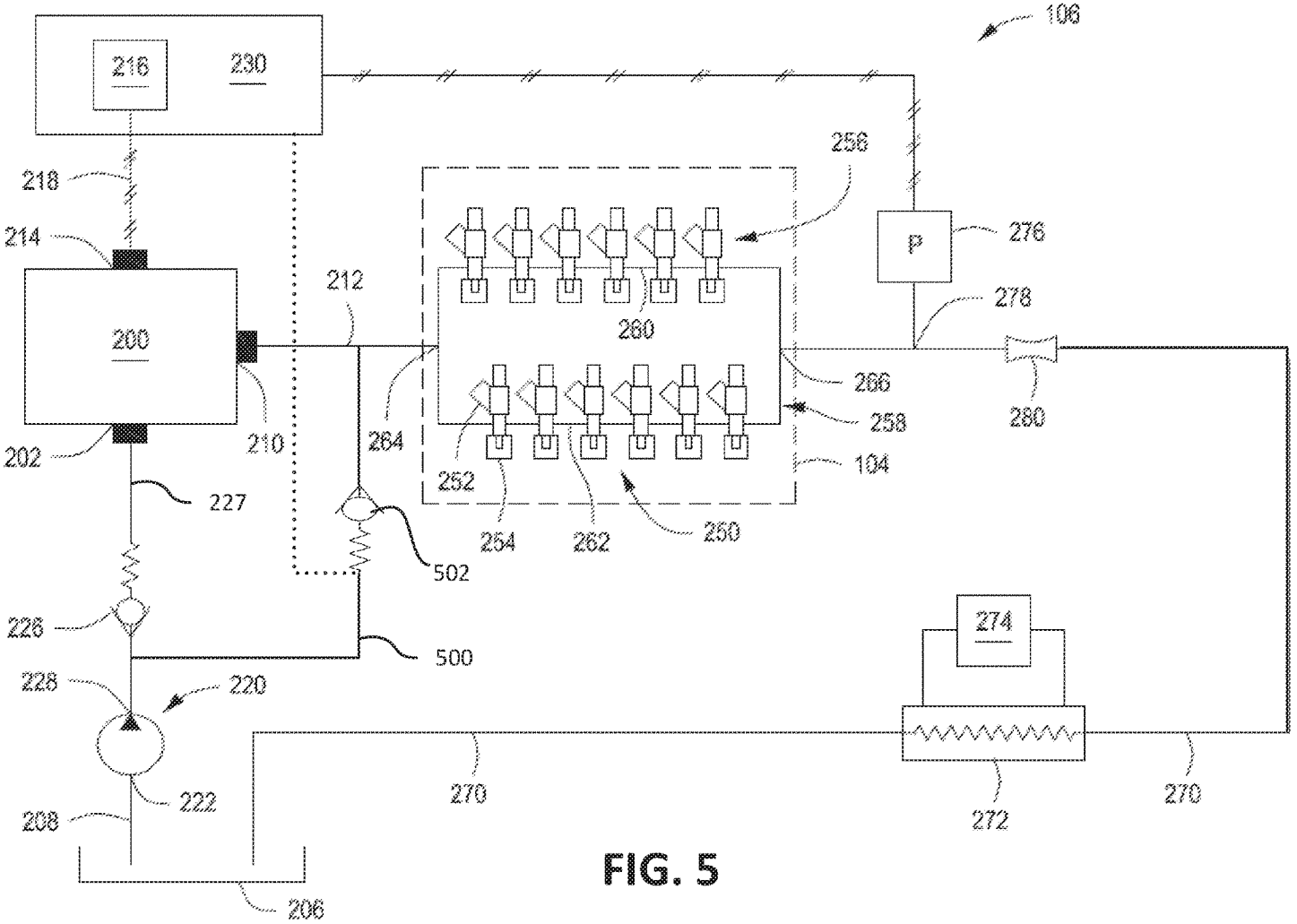
FIG. 5 is a schematic view of a fluid injection system, according to an aspect of the disclosure.

FIG. 5 shows a schematic view of a fuel supply system 106, according to an aspect of the disclosure. The fuel supply system 106 illustrated in FIG. 5 is similar to that illustrated in FIG. 2, however, as illustrated in FIG. 5, a flush conduit 500 may be fluidly coupled to the outlet port 210 of the fluid conditioning module 200, for example, via fluid communication with the module outlet conduit 212. The flush conduit 500 may be configured as a return loop to the fluid conditioning module 200, for example, via fluid communication with the module inlet conduit 227. As shown, a flush valve 502 may be disposed in the flush conduit 500 and may be configured to control a flowrate of fluid therethrough. In certain aspects, the flush valve 502 may be an electrically controlled valve. As an example, the controller 230 may be operatively coupled to the flush valve 502. As such, the controller 230 may be configured to adjust a flowrate of a fluid through the injector assembly inlet conduit 264 by controlling a flowrate of fluid through the flush conduit 500. In other aspects, the flush valve 502 may be configured as a pressure relief valve.

As illustrated, for example, in FIGS. 4 and 5, the flush conduits 400, 500 and flush valves 402,502 provide fluid control prior to the HPFS (e.g., the injector assembly inlet conduit 264). As an example, the valves 402, 502 can be opened for a predetermined period of time, while the fluid conditioning module 200 is operated, thereby allowing sufficient fuel to bypass back to the fluid reservoir 206 or the LPFS inlet (e.g., the module inlet conduit 227) to remove any dirt/debris as well as air from the fuel supply system 106. The flush valves 402, 502 may be or comprise a solenoid valve actuated at the selected times for the selected durations by the controller 230. The flush valves 402, 502 may be or comprise an automatic flush valve configured to cycle after a time period or determined pressure of the LPFS. As an example, the flush schedule may be prior to every start, logically driven to be after any interval long enough to accommodate any of the system violations, manually at the push of a "flush button", or a combination thereof. As a further example, the flush cycle may be run prior to engaging the starter to start the engine (e.g., a time delay prior to starting). Many HPFSs feature fuel flow to provide cooling for the injectors. In these instances, the flush cycle could involve additional time after the flush valve closes to flush fuel through the injectors. Other control procedures may be used.

As illustrated, for example, in FIGS. 4 and 5, the flush conduits 400, 500 and flush valves 402,502 provide isolation of the fluid conditioning module 200 fluid, and in particular the filters 304, 306. As such, fluid is being directed through the flush conduits 400, 500 (e.g., flushing operation), the only power required by the motor system 308 is the power needed to push the fluid through the filters 304, 306 and to the outlet port 210. As an example, a flushing operation may be executed at shutdown with the fluid conditioning module 200 operating for a time period (e.g., 2-10 seconds) after the engine stops running. A power reading during this flushing operation may operate as a diagnostic to indicate the level of filter loading (e.g., clogging of filters 304, 306). Such an indication may be used to determine whether to change the filters 304, 306. In certain aspects, the controller 230 may be configured to determine a power of the motor system 308 (or component thereof). Accordingly, a pressure sensor typically used to determine filter loading may not be necessary and may be removed from the fuel supply system 106.

Figure 6:
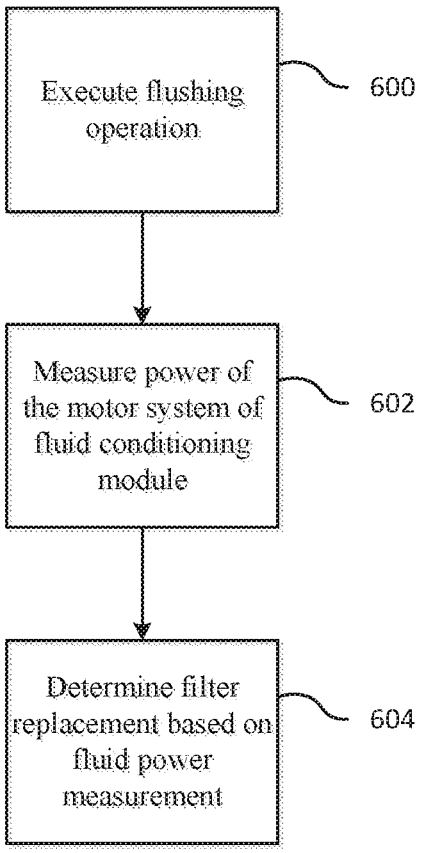
FIG. 6 is a flow chart for a method, according to an aspect of the disclosure.

FIG. 6 illustrates an example method of determining filter loading. Although the method is described in relation to filters 304, 306 of the fluid conditioning module 200, other filters under similar fluid conditions may be processed using the method. In step 600, a flushing operation may be executed. As an example, the flushing operation includes allowing fluid to pass through a flush conduit (e.g., flush conduits 400, 500), as opposed to flowing through the injector assembly inlet conduit 264. Since the fluid is bypassing the injector assembly inlet conduit 264, the fluid dynamics of the fluid conditioning module 200 may be at least partially isolated. As such a power draw of the motor system 308 may be measured, for example via the controller 230, at step 602. The power measurement from the motor system 308 may be correlated to a filter loading, for example using look-up tables, heuristics, machine learning, or other calculations to relate the power state of the motor system 308 to various conditions/states of the filters 304, 306. Accordingly, a determination may be made to replace the filters 304, 306 based upon the power measurement (e.g., the correlation to filter loading). Since the operation of the motor system 308 may be isolated during the flushing condition, such correlations may be optimal in representing the filter loadings.

Figure 7:
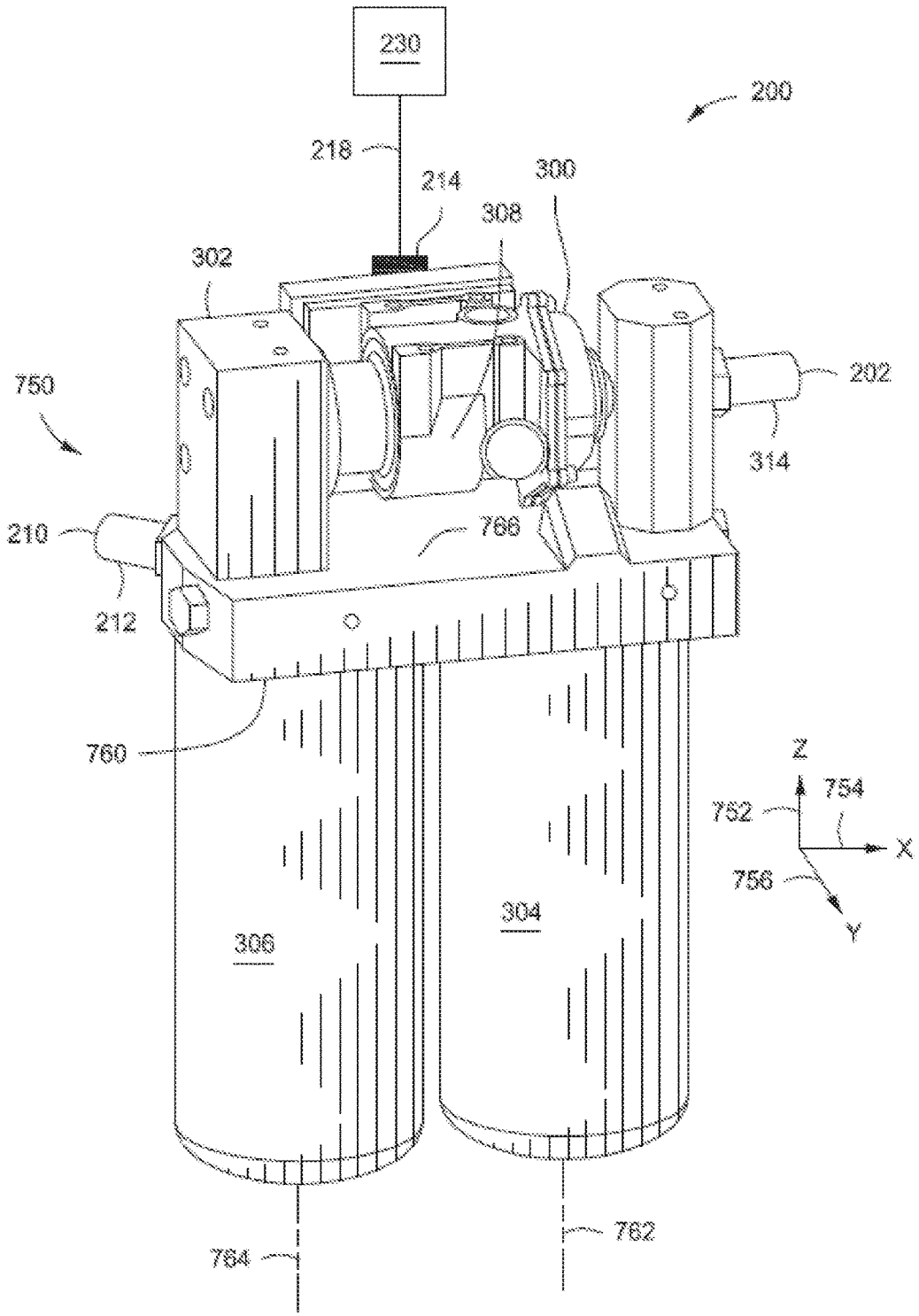
FIG. 7 is a perspective view of a fluid conditioning module, according to an aspect of the disclosure.

FIG. 7 shows a perspective view of a fluid conditioning module 200, according to an aspect of the disclosure. The fluid conditioning module 200 may include a block 750 that functions to provide points of attachment for any of the components of the fluid conditioning module 200, to define fluid passages to effect fluid communication between components of the fluid conditioning module 200, or combinations thereof. It will be appreciated that the block 750 may be formed and consist of a single unitary part, or alternatively, the block 750 may include a plurality of parts fastened to one another by threaded fasteners, rivets, welding, brazing, interference fits, combinations thereof, or any other material fasteners or techniques known in the art.

In FIG. 7, a height or vertical direction 752 extends along the z-axis, a width direction 754 extends along the x-axis, and a depth direction 756 extends along the y-direction, where the x-axis, the y-axis, and the z-axis may all be mutually normal or perpendicular to one another.

The first filter 304 and the second filter 306 are each mounted to a lower surface 760 of the block 750. A longitudinal axis 762 of the first filter 304 and a longitudinal axis 764 of the second filter 306 may each extend away from the lower surface 760 of the block along the height direction 752. The longitudinal axis 762 of the first filter 304 may be substantially parallel to the longitudinal axis 764 of the second filter 306. Further, the longitudinal axis 762 of the first filter 304 and the longitudinal axis 764 of the second filter 306 may each lie in a plane defined by the width direction 754 and the height direction 752.

The block 750 may define the inlet port 202, the outlet port 210, or both, of the fluid conditioning module 200. It will be appreciated that the block 750 may include fluid fittings coupled thereto, and that such fluid fittings may be said to be part of the block 750 and define the inlet port 202, the outlet port 210, or both.

The recirculation pump 300, the delivery pump 302, and the motor system 308 are shown fastened to an upper surface 766 of the block 750, where the upper surface 766 of the block 750 is opposite the lower surface 760 of the block along the height direction 752. The recirculation pump 300, the delivery pump 302, and the motor system 308 may be fastened to the block 750 by threaded fasteners, or any other fasteners known in the art.

INDUSTRIAL APPLICABILITY

The present disclosure is applicable to fluid conditioning systems in general, and more particularly to a fuel conditioning system for a fuel injection system for an internal combustion engine. The evolution of diesel fuel injection systems has involved ever increasing injection pressures. As pressures increase, the wear of the high pressure fuel systems (HPFS) increases exponentially. To address this wear, the present disclosure provides a flushing architecture and operation to minimize debris and unwanted matter entering the HPFS. In an aspect, and referring to FIGS. 4 and 5, the flush conduits 400, 500 and flush valves 402,502 provide fluid control prior to the HPFS (e.g., the injector assembly inlet conduit 264). As an example, the valves 402, 502 can be opened for a predetermined period of time, while the fluid conditioning module 200 is operated, thereby allowing sufficient fuel to bypass back to the fluid reservoir 206 or the LPFS inlet (e.g., the module inlet conduit 227) to remove any dirt/debris as well as air from the fuel supply system 106. The flush conduits 400, 500 and flush valves 402,502 provide isolation of the fluid conditioning module 200 fluid, and in particular the filters 304, 306. As such, fluid is being directed through the flush conduits 400, 500 (e.g., flushing operation), the only power required by the motor system 308 is the power needed to push the fluid through the filters 304, 306 and to the outlet port 210. A power reading during this flushing operation may operate as a diagnostic to indicate the level of filter loading (e.g., clogging of filters 304, 306). Such an indication may be used to determine whether to change the filters 304, 306.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A fluid injection system, comprising:

a fluid injector assembly;

a fluid conditioning module having an outlet port that is fluidly coupled to an inlet port of the fluid injector assembly via an injector assembly inlet conduit, wherein the fluid conditioning module includes:

a motor system operatively coupled to the controller;

a recirculation pump operatively coupled to the motor system, an outlet of the recirculation pump being fluidly coupled to an inlet of the recirculation pump via a first filter; and a delivery pump operatively coupled to the motor system, an inlet of the delivery pump being fluidly coupled to an outlet of the first filter, an outlet of the delivery pump being fluidly coupled to the injector assembly inlet conduit;

a flush conduit fluidly coupled to the outlet port of the fluid conditioning module;

a flush valve disposed in the flush conduit and configured to control a flowrate of fluid therethrough; and a controller operatively coupled to the fluid conditioning module and the flush valve, the controller being configured to adjust a flowrate of a fluid through the injector assembly inlet conduit by controlling the flowrate of fluid through the flush conduit, the controller being further configured to determine a filter blockage of the first filter based on a measurement of power of the motor system.

2. The fluid injection system of claim 1, further comprising a return conduit in fluid communication with an outlet of the fluid injector assembly and a reservoir, wherein the reservoir is configured to provide a source of fluid to the fluid conditioning module, wherein the flush conduit is in fluid communication with the return conduit.

3. The fluid injection system of claim 1, further comprising:

an inlet conduit configured to be fluidly coupled to the fluid conditioning module and configured to facilitate a passage of fluid to the fluid conditioning module; and an inlet valve disposed in the inlet conduit and configured to control a flowrate of fluid to the fluid conditioning module.

4. The fluid injection system of claim 3, wherein the flush conduit is fluidly coupled to the inlet conduit.

5. The fluid injection system of claim 1, wherein the outlet of the delivery pump is fluidly coupled to the injector assembly inlet conduit via a second filter.

6. The fluid injection system of claim 1, wherein the controller is further configured to adjust the flowrate of the fluid through the injector assembly inlet conduit by adjusting a speed of the motor system.

7. The fluid injection system of claim 1, wherein the motor system includes a motor operatively coupled to the delivery pump via a first shaft, the controller being further configured to adjust a speed of the motor.

8. The fluid injection system of claim 7, wherein the recirculation pump is operatively coupled to the motor via a second shaft.

9. The fluid injection system of claim 1, wherein the delivery pump is a positive displacement pump.

10. The fluid injection system of claim 1, wherein the fluid injector assembly is a fuel injection assembly for a reciprocating internal combustion engine.

11. The fluid injection system of claim 1, wherein the fluid injector assembly is an exhaust aftertreatment fluid injection assembly that is fluidly coupled to an exhaust duct of an internal combustion engine.

12. The fluid injection system of claim 1, wherein the measurement of power of the motor system is executed while fluid is flowing from the outlet port of the fluid conditioning module through the flush conduit.

13. The fluid injection system of claim 5, wherein the controller is further configured to determine a filter blockage of the second filter based on a measurement of power of the motor system.

* * * * *